US008322644B2

(12) United States Patent
Nakada et al.

(10) Patent No.: US 8,322,644 B2
(45) Date of Patent: Dec. 4, 2012

(54) ROLL-SHEET FEEDING DEVICE AND IMAGE FORMING APPARATUS

(75) Inventors: Kikuya Nakada, Saitama (JP); Akito Yoshimaru, Kanagawa (JP); Atsuo Tokunaga, Kanagawa (JP); Yoshio Miyamoto, Kanagawa (JP); Shigeru Morinaga, Kanagawa (JP); Yusuke Harasawa, Saitama (JP); Kentaro Uehara, Saitama (JP); Satoshi Hirata, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 280 days.

(21) Appl. No.: 12/771,317

(22) Filed: Apr. 30, 2010

(65) Prior Publication Data

US 2010/0327515 A1 Dec. 30, 2010

(30) Foreign Application Priority Data

Jun. 25, 2009 (JP) ..... 2009-150819

(51) Int. Cl.
*B65H 75/30* (2006.01)

(52) U.S. Cl. ..... 242/394.1; 242/420.4; 242/545.1; 271/225

(58) Field of Classification Search ..... 242/420.4, 242/394, 394.1, 545, 545.1; 271/225
See application file for complete search history.

(56) References Cited

U.S. PATENT DOCUMENTS

| | | | | |
|---|---|---|---|---|
| 5,511,744 | A * | 4/1996 | Abe et al. | 242/564.5 |
| 5,758,840 | A * | 6/1998 | Murakami | 242/415 |
| 6,435,446 | B1 * | 8/2002 | Matsuzawa | 242/422.4 |
| 8,002,214 | B2 * | 8/2011 | Genta et al. | 242/420.6 |
| 8,011,611 | B2 * | 9/2011 | Yoshimaru et al. | 242/421 |

FOREIGN PATENT DOCUMENTS

| | | |
|---|---|---|
| JP | 2003-276264 | 9/2003 |
| JP | 2006-248683 | 9/2006 |

* cited by examiner

*Primary Examiner* — Sang Kim
(74) *Attorney, Agent, or Firm* — Cooper & Dunham LLP

(57) ABSTRACT

A roll-sheet feeding device having a roll sheet wound in a roll to feed a portion of the roll sheet to an image forming unit, includes a progressive mechanism to transmit a drive force from a drive source to transfer the portion of the roll sheet from the roll in a progressive direction, a roll-sheet drive mechanism to receive the drive force transmitted via the portion of the roll sheet transferred in the progressive direction, a rewinding mechanism to transfer the portion of the roll sheet in a direction opposite to the progressive direction via the roll-sheet drive mechanism to rewind the roll sheet, and a regenerating mechanism to obtain the drive force from the roll-sheet drive mechanism and transmit the obtained drive force to the progressive mechanism to regenerate the transmitted drive force as another drive force in addition to the drive force from the drive source.

15 Claims, 10 Drawing Sheets

ROLL-SHEET FEEDING DEVICE AND IMAGE FORMING APPARATUS

BACKGROUND OF THE INVENTION

1. Field of the Invention

The present invention generally relates to a roll-sheet feeding device that feeds a roll-sheet type medium such as a roll sheet wound in a roll, and an image forming apparatus having the roll-sheet feeding device such as a printer, a plotter, a facsimile machine, and a copier.

2. Description of the Related Art

There are a large-scale copiers that handle large size drawing documents such as those of A0 or A1 size, and electrophotographic image forming apparatuses such as a printer, or other types of printers that generally form images on a large size sheet medium. Such image forming apparatuses include a roll-sheet feeding device, which generally employs a roll sheet as a sheet medium and transfers the roll sheet to an image forming unit to improve the convenience of handling the sheet type medium. The roll sheet is configured to include a sheet tube used as a roll core around which a long paper-sheet is rolled. In the roll-sheet feeding device, the roll sheet is rotationally supported such that the sheet is fed to the image forming unit at a predetermined linear speed based on the rotational speed of the roll sheet.

The related art supporting types that can rotationally support the roll sheet in the roll-sheet feeding device include a spool type sheet support or a flange type sheet support to accommodate various sizes of roll sheets.

In the spool type sheet support, spool is placed in the sheet tube to enable the roll sheet to rotate. In the spool type sheet support, when an unwind mechanism for rewinding the roll sheet is provided in the roll-sheet feeding device, a drive transmission mechanism can be easily provided on the spool to rotationally drive the roll sheet easily in the roll-sheet feeding device. At the same time, however, when replacing the roll sheet, a user has to place the long spool in the roll sheet, which may impose a cumbersome operation on the user.

By contrast, in the flange type sheet support, flange members are inserted from both ends of the sheet tube and the flange members are rotationally supported in the roll-sheet feeding device to enable the roll sheet to rotate. In the flange type sheet support, the user has to only insert the flange members from both ends of the roll sheet when replacing the roll sheet, and thus the flange type sheet support provides a superior operability for the user.

In the flange type sheet support, drive force can be directly transmitted to the roll sheet in a manner such that an outer diameter of the flange member is made larger than a maximum outer diameter of the roll sheet. Note that the maximum outer diameter of the roll sheet means the roll sheet indicates an outer diameter of the roll sheet having a maximum amount of remaining roll sheet.

In addition, Japanese Patent Application Publication No. 2003-276264, for example, discloses a roll-sheet feeding device having a flange type sheet support in which the outer diameter of flange members is made smaller than the maximum diameter of the roll sheet, and the flange members are rotationally supported by receiving rolls, thereby enabling the roll sheet to rotate in the roll-sheet feeding device.

However, the roll-sheet feeding device having the above flange type sheet support has the following drawbacks.

In image forming apparatuses including inkjet printers, a roll sheet may have to be intermittently transferred while forming images. When the roll sheet is intermittently transferred, the roll sheet is transferred in a progressive (winding) direction due to inertia, which may make the roll sheet loose. Thus, there may need some looseness prevention device to prevent the roll sheet from being loosened in the roll-sheet feeding device. For preventing the roll sheet from getting loose, the roll-sheet feeding device may need to include a pulling mechanism working as a brake by which the roll sheet is pulled in a rewinding direction opposite to the winding direction to cancel out the inertia of the roll sheet. The pulling mechanism may include a mechanism to generate load (load generating mechanism), such as rotational load, as a pulling force generating mechanism.

However, when the load generating mechanism generating large load is provided in the roll-sheet feeding device for preventing the roll sheet from being loosened, brake force of a large rotational load generated by the load generating mechanism may exceedingly be imposed on a drive source that transfers the roll sheet in a sheet feeding direction. As a result, an electric motor of the drive source need be increased in size, which results in large power consumption.

SUMMARY OF THE INVENTION

It is a general object of at least one embodiment of the present invention to provide a flange type roll-sheet feeding device capable of preventing a roll sheet from being loosened while stably transferring the roll sheet, reducing the load imposed on the electric motor and lowering power consumption, and an image forming apparatus including such a flange type roll-sheet feeding device that substantially eliminate one or more problems caused by the limitations and disadvantages of the related art.

In one embodiment, there is provided a roll-sheet feeding device having a roll sheet wound in a roll to feed a portion of the roll sheet to an image forming unit. The roll-sheet feeding device includes a progressive mechanism configured to transmit a drive force from a drive source to transfer the portion of the roll sheet from the roll in a progressive direction; a roll-sheet drive mechanism configured to receive the drive force transmitted via the portion of the roll sheet transferred in the progressive direction; a rewinding mechanism configured to transfer the portion of the roll sheet in a direction opposite to the progressive direction via the roll-sheet drive mechanism to rewind the roll sheet; and a regenerating mechanism configured to obtain, when the roll-sheet drive mechanism receives the drive force via the portion of the roll sheet transferred in the progressive direction, the drive force from the roll-sheet drive mechanism and transmit the obtained drive force to the progressive mechanism to regenerate the transmitted drive force as another drive force in addition to the drive force from the drive source.

In another embodiment, there is provided an image forming apparatus that includes an image forming unit configured to form images on a roll sheet; and the above roll-sheet feeding device.

Other objects and further features of embodiments will be apparent from the following detailed description when read in conjunction with the accompanying drawings.

DESCRIPTION OF THE PREFERRED EMBODIMENTS

In the following, embodiments for carrying out the present invention will be described by referring to the accompanying drawings.

[Embodiment]

A roll-sheet feeding device and an inkjet printer according to an embodiment of the invention are described with reference to FIGS. 1 through 8.

Note that the inkjet printer according to the embodiment corresponds to an image forming apparatus according to the embodiment.

Figure 1A:
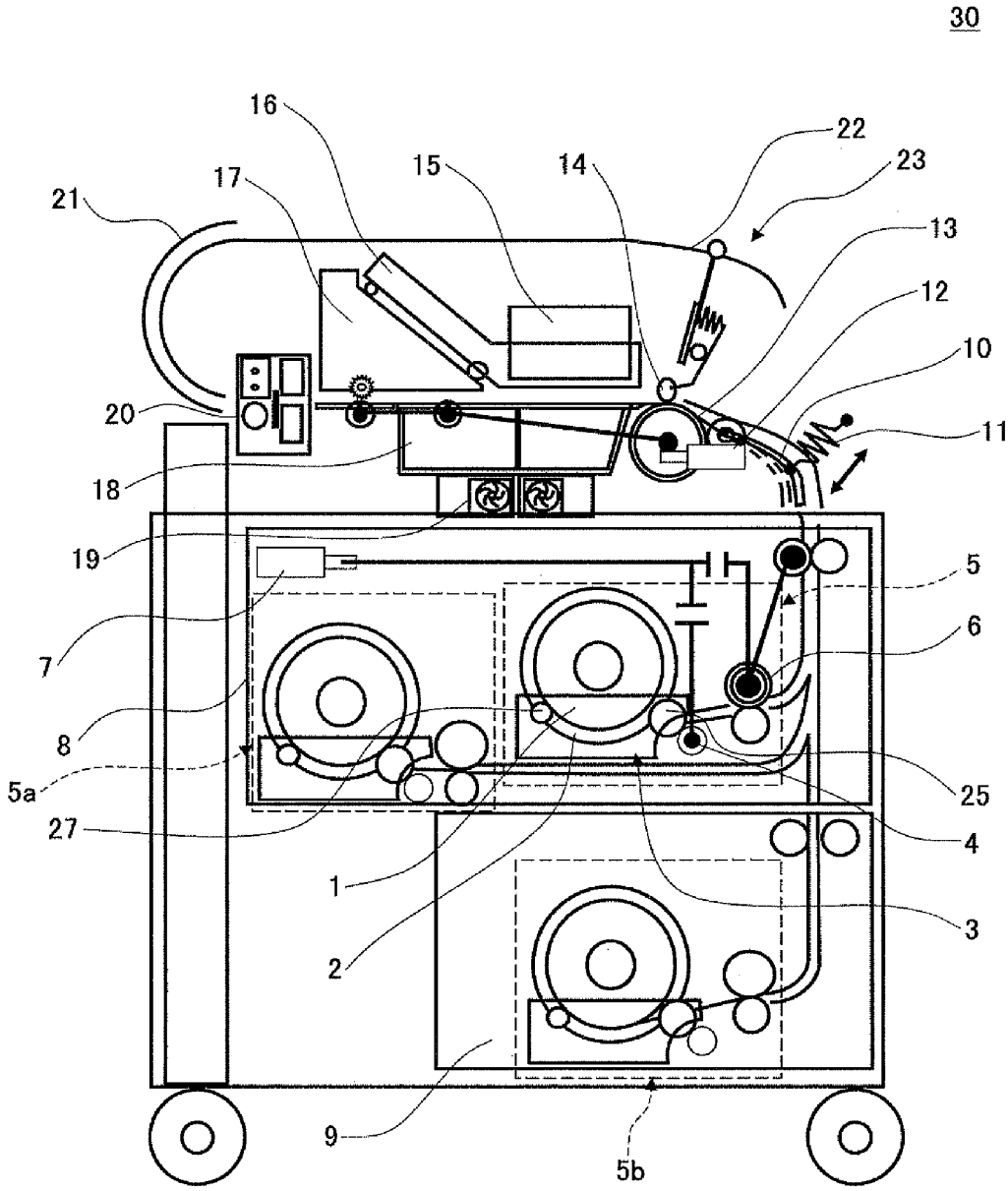
FIG. 1A is a schematic view illustrating an entire configuration of an inkjet printer according to an embodiment.
Figure 1B:
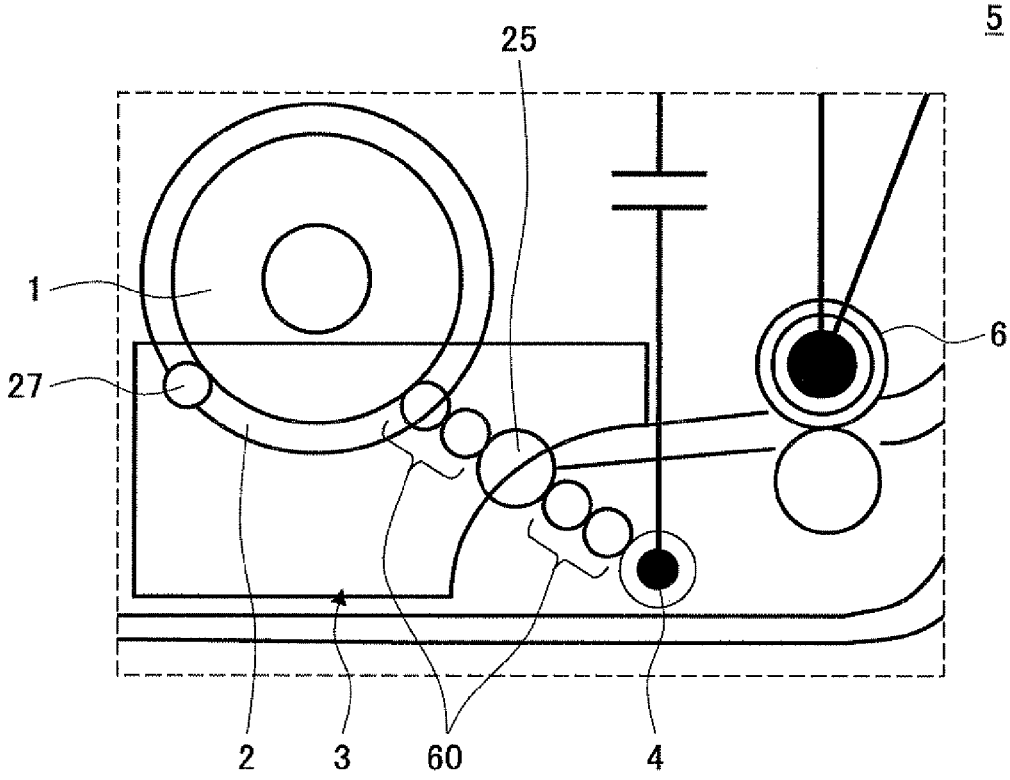
FIG. 1B is another schematic view illustrating the entire configuration of the inkjet printer according to the embodiment.

First, an entire configuration of the inkjet printer is described with reference to FIGS. 1A and 1B. FIG. 1A is a schematic diagram illustrating the entire configuration of the inkjet printer according to the embodiment, and FIG. 1B is an enlarged view of a roll-sheet feeding device in the inkjet printer of FIG. 1A.

As illustrated in FIG. 1A, the inkjet printer 30 according to the embodiment includes roll-sheet feeding units 5, 5*a*, and 5*b*, and an image forming unit 23. The roll-sheet feeding units 5, 5*a*, and 5*b* correspond to the roll-sheet feeding devices according to the embodiment. That is, the inkjet printer 30 according to the embodiment includes three roll-sheet feeding devices.

As illustrated in FIG. 1A, the image forming unit 23 includes a sheet-tension application unit 10, a resist roller 13, a resist pressure roller 14, a head 15, a carriage 16, a main scanning stay 17, a chamber 18, a suction fan 19, a cutter 21, a reverse sheet discharge guide 21, and a sheet receiving tray 22. The sheet-tension application unit 10 includes a reciprocating spring 11 provided on an inner periphery of the image forming unit and a drive motor 12.

The roll-sheet feeding unit 5 includes flange members 1, a roll sheet 2, flange receiving supports 3, a rewinding roller 4, a sheet-feeding roller 6, and a drive unit 7.

As illustrated in FIG. 1A, the flange member 1 has a disk shape, an outer diameter of which is smaller a maximum outer diameter of the roll sheet 2. The flange members 1 are attached to both ends of the roll sheet 2.

The roll sheet 2 is composed of a long paper-sheet and a sheet tube (i.e., roll core) around which the long paper-sheet is rolled. There are various sizes of the roll sheets 2 having sheet tubes of different sizes; however, a sheet tube having an inner diameter of 2 or 3 inches, which is a typical size of the sheet tube, may be employed as the sheet tube of the roll sheet in the inkjet printer 30 according to the embodiment. The roll sheets each includes the sheet tube having the inner diameter of 2 or 3 inches.

The flange receiving supports 3 include intermediate rolls 25 and supporting rolls 27. The flange members 1 are mounted on flange receiving supports 3. The flange receiving supports 3 rotationally support outer peripheral surfaces of the flange members 1.

The intermediate roll 25 supports the outer peripheral surface of the flange member 1 atone end of the flange receiving support 3 (i.e., sheet-feeding roller 6 side), while abutting on (or being in contact with or engaged with) the rewinding roller 4. The supporting roll 27 supports the outer peripheral surface of the flange members 1 at the other end of the flange receiving support 3. The intermediate rolls 25 correspond to common support rolls of the embodiment, which intermediately transmit drive force from the rewinding roller 4 to the flange members 1.

The rewinding roller 4 is made long such that the rewinding roller 4 is in contact with the intermediate rolls 25 on the flange receiving supports 3 located at both ends of the roll sheet 2. The rewinding roller 4 is driven by the drive unit 7 to unwind the roll sheet 2. Specifically, friction contact generated between the rewinding roller 4, the intermediate rolls 25 and the flange members 1 transmits the drive force from the drive unit 7 to the rewinding roller 4, so that the flange members 1 are inversely rotated. Note that the rewinding roller 4 is provided such that the rewinding roller 4 is in contact with one of the intermediate rolls 25 on the flange receiving supports 3 located at both ends of the roll sheet 2.

The sheet-feeding roller 6 is composed of a pair of rollers driven by the drive unit 7 to rotate, so that the roll sheet is transferred between the pair of rollers in the winding direction to the sheet-tension application unit 10.

The drive unit 7 includes, as will be described later, a drive source composed of a DC motor, a progressive feeding mechanism, a roll-sheet drive mechanism, a regenerating mechanism, and a rewinding mechanism. The drive unit 7 transmits the drive force to the sheet-feeding roller 6 or the rewinding roller 4 for transferring the roll sheet 2 in the progressive (winding) direction from the sheet-feeding roller 2 or the rewinding roller 4 or in the a rewinding direction opposite to the winding direction to rewind the roller sheet 2.

An upper roll tray 8 includes a roll-sheet feeding unit 5*a* that includes flange members 1, a roll sheet 2, flange receiving supports 3, a rewinding roller 4, and a sheet-feeding roller 5. Further, a lower roll tray 9 is provided below the upper roll tray 8 and includes a roll-sheet feeding unit 5*b* that includes flange members 1, a roll sheet 2, flange receiving supports 3, a rewinding roller 4, and a sheet-feeding roller 5. That is, the inkjet printer 30 according to the embodiment includes three roll-sheet feeding units 5, 5*a*, and 5*b*.

Next, a roll-sheet feeding operation and an image forming operation of the inkjet printer are described with reference to FIG. 1A.

First, a progressive operation of feeding the roll sheet in the progressive (winding) direction from the roll-sheet feeding device 5 to the image forming unit 23 is described.

When the roll sheet 2 is rolled out in the progressive (winding) direction from the roll-sheet feeding device 5 to the image forming unit 23, the drive unit 7 forwardly rotates to rotate the sheet-feeding roller 6 in a counterclockwise direction as shown in FIG. 1A, thereby rolling out the roll sheet 2. When a portion of the roll sheet 2 is rolled out, the intermediate rolls 25 rotate in clockwise directions in accordance with rotating the flange members 1 attached to the ends of the roll sheet 2 in the counterclockwise directions. The rewinding roller 4 is not rotationally driven by the drive unit 7 but is rotated in the counterclockwise direction by the drive force transmitted from the intermediate rolls 25. The intermediate rolls 25 and the rewinding roller 4, and the intermediate rolls 25 and the flange members 1 are engaged with one another so as not to slip on one another. Specifically, the intermediate rolls 25 may be made of gears so that the intermediate rolls 25 and the rewinding roller 4, and the intermediate rolls 25 and the flange members 1 are engaged with one another via the gears; or the intermediate rolls 25 may be coated with rubber so that the intermediate rolls 25 and the rewinding roller 4, and the intermediate rolls 25 and the flange members 1 are engaged with one another via the rubber due to friction. Alternatively, gears 60 (see FIG. 1B) may be provided between the intermediate rolls 25 and the rewinding roller 4, and between the intermediate rolls 25 and the flange members 1 so that the intermediate rolls 25 and the rewinding roller 4, and the intermediate rolls 25 and the flange members 1 are engaged with one another via the gears 60. Further, rubber members may be provided between the intermediate rolls 25 and the rewinding roller 4, and between the intermediate rolls 25 and the flange members 1 to function as the gears 60 so that the intermediate rolls 25 and the rewinding roller 4, and the intermediate rolls 25 and the flange members 1 are engaged with one another via the rubber. Note that the roll sheet 2 is not loosened between the sheet-feeding roller 6 and the roll sheet 2 itself.

Meanwhile, it is desirable to form images on the roll sheet 2 in a direction perpendicular to a sheet-feeding direction of the roll sheet 2 within a predetermined duration. Thus, an intermittent transfer operation that reciprocates transferring and pausing for a predetermined duration is carried out while forming the images on the roll sheet 2. When a portion of the roll sheet 2 is rolled out by carrying out the intermittent transfer operation, it is desirable to stop the rotation of the flange member 1 approximately the same time as or before the rotation of the sheet-feeding roller 6 is stopped in order to prevent the roll sheet 2 from loosening between the sheet-feeding roller 6 and flange members 1 when the roll out of the roll sheet 2 is stopped.

Accordingly, the portion of the roll sheet 2 is rolled out while applying brake force to the roll sheet 2 via the rewinding roller 4, the intermediate rolls 25, and the flange members 1. An example of a method for applying brakes to the rewinding roller 4 includes applying brakes to the rewinding roller 4 with a torque limiter or the like, and rolling out a portion of the roll sheet 2 while applying the brakes to the rewinding roller 4. The torque limiter is an example of a load generating mechanism in the embodiment.

The rolled out portion of the roll sheet 2 transferred by the sheet-feeding roller 6 is transferred to the sheet-tension application unit 10 provided in a sheet transfer path of the inkjet printer. The sheet-tension application unit 10 includes a transfer guide (not shown) and the spring 11 and configured to work as a buffer for the tension of the rolled out portion of the roll sheet 2.

The rolled out portion of the roll sheet 2 transferred between the resist roller 13 and the resist pressure roller 14 is further transferred on a platen plate provided on the chamber 18. Negative pressure is formed inside the chamber by the suction fan 19 provided below the chamber 18, and the rolled out portion of the roll sheet 2 clings to the platen plate due to the number of pores provided in the platen plate. The flatness of the rolled out portion of the roll sheet 2 is thus maintained.

The carriage 16 having the head 15 for discharging ink is arranged on the platen plate, and reciprocates along the main scanning stay 17 in a width direction of the rolled out portion of the roll sheet 2 while discharging ink from the head 15 to the rolled out portion of the roll sheet 2 on the platen plate to form images thereon. A predetermined portion of the roll sheet 2 is fed (intermittent transfer) from the resist roller 13 every time the carriage 16 travels along the width of the head 15, and the cutter 20 cuts the rolled out portion of the roll sheet 2 to a predetermined length when image formation is complete. The cut piece of the roll sheet 2 is transferred along the reverse sheet discharge guide 21 which is then discharged to the sheet receiving tray 22.

Next, a description is given of a rewinding operation in which the rolled out portion of the roll sheet 2 is transferred in the rewinding direction opposite to the progressive (winding) direction to be rewound on the roll sheet 2.

When the rolled out portion of the roll sheet 2 is rewound from the image forming unit 23 to the roll-sheet feeding device 5, the drive unit 7 inversely rotates to rotate the sheet-feeding roller 6 in a clockwise direction as shown in FIG. 1A. When the rolled out portion of the roll sheet 2 is rewound on the roil sheet 2, a one-way clutch (not shown) transmits the drive force to the rewinding roller 4, the rewinding roller 4 rotates in a clockwise direction to rotate the intermediate rolls 25 abutting to the rewinding roller 4 in counterclockwise directions, and the flange members 1 abutting the intermediate rollers 25 rotate in clockwise directions. Along with the above rotation, the roll sheet 2 rotates in a clockwise direction to retract a front end of the rolled out portion of the roll sheet 2 from a position of the cutter 20 to a predetermined standby position.

There are two standby positions. A first standby position is a normal standby position where the rolled out sheet is sandwiched between the resist roller 13 and the resist pressure roller 14. A second standby position is located at a position above a merge position where portions of different roll sheets arrive, and is used when a subsequent image is formed on a portion of a roll sheet having a sheet tube of a different size. A sensor known in the art is used to determine whether the front end of the rolled out portion of the roll sheet 2 is retracted to the predetermined standby position. When rewinding the roll sheet 2, the sheet-feeding roller 6 and the rewinding roller 4 rotate at constant speeds. However, since the diameter of the roll sheet 2 rotated according to the rotation of the rewinding roller 4 via the intermediate rolls 25 and the flange members 1 successively decreases with a consumption amount of the roll sheet 2, an amount (i.e., length) of rewinding the roll sheet 2 gradually decreases.

The smaller the outer diameter of the roll sheet 2 is, the smaller amount of rewinding the roll sheet 2 will be. The sizes of the sheet-feeding roller 6, the rewinding roller 4, the intermediate rolls 5, and the flange members 1 are comparatively designed such that the rolled out portion of the roll sheet 2 is not loosened even if a remaining amount of the roll sheet 2 is little. Accordingly, a rolled out portion longer than a length corresponding to a rotational amount of the sheet-feeding roller 6 is rewound by a rotational amount of the rewinding roller 4 while the remaining amount of the roll sheet 2 is still large so that the outer diameter of the roll sheen 2 is large. However, the difference between the rotational amounts may be cancelled out due to the slipping of the load generating mechanism such as the torque limiter. Thus, the rolled out portion of the roll sheet 2 may not be loosened and rewound while retaining a predetermined tension.

Next, the drive unit of the roll-sheet feeding device according to the embodiment is described with reference to FIGS. 2 through 4.

Figure 2:
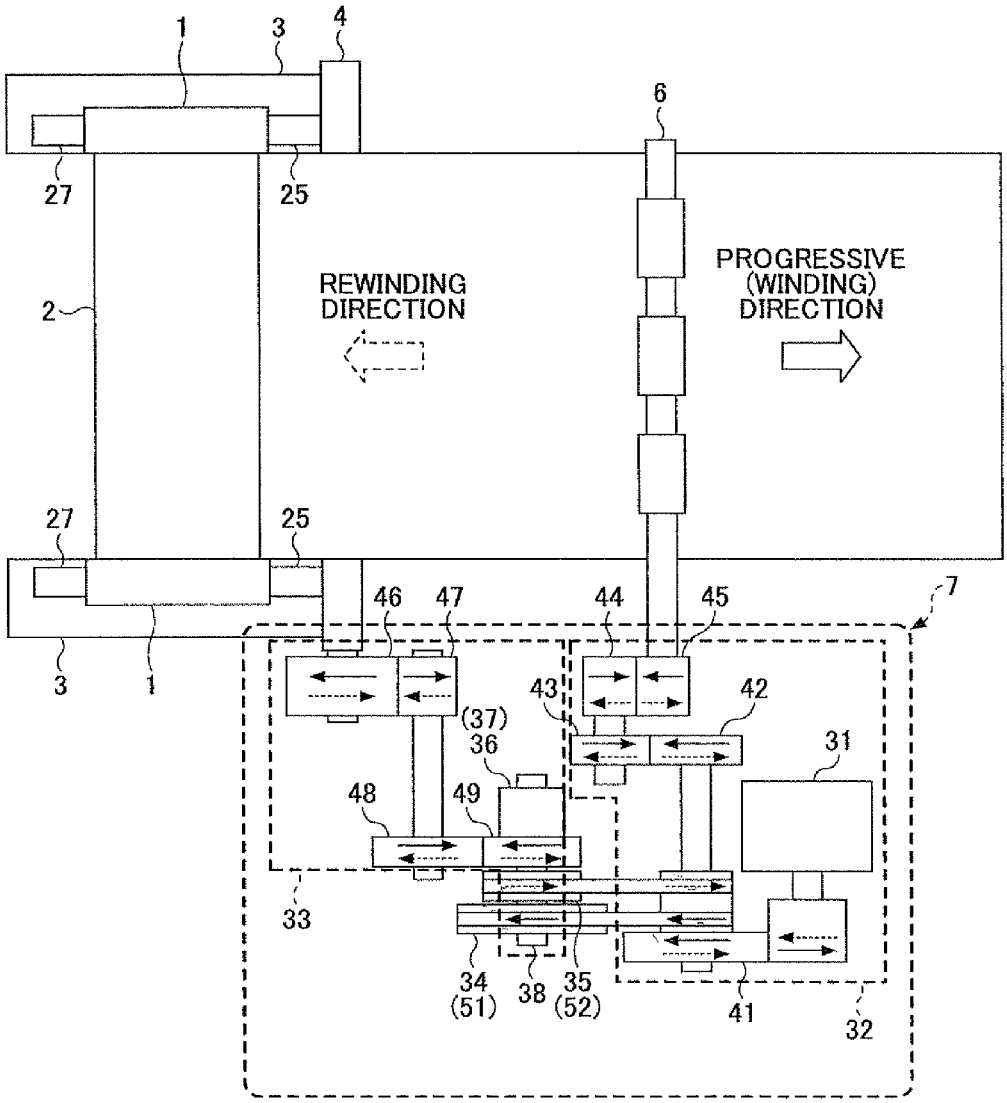
FIG. 2 is a diagram schematically illustrating a drive unit of the roll-sheet feeding device according to the embodiment.

FIG. 2 is a diagram schematically illustrating the drive unit of the roll-sheet feeding device according to the embodiment. FIGS. 3 and 4 are perspective views each illustrating a regenerating mechanism and a rewinding mechanism of the drive unit of the roll-sheet feeding device according to the embodiment. FIG. 3 illustrates the drive unit including fittings to fit and support pulleys and gears of the regenerating mechanism and the rewinding mechanism and FIG. 4 illustrates the drive unit without the fittings.

The drive unit according to the embodiment includes a drive source 31, a progressive mechanism 32, a roll-sheet drive mechanism 33, a regenerating mechanism 34 and a rewinding mechanism 35.

The drive source 31 generates drive force to transfer rolled out portions of the roll sheet in a forward and an inverse directions. That is, the rolled out portions of the roll sheet is transferred in the forward and the inverse directions by the drive source 31. As the drive source 31, a DC motor may be employed and the drive source 31 may hereinafter be also called as the "DC motor 31".

The progressive mechanism 32 transmits the drive force to a portion of the roll sheet 2 via the sheet-feeding roller 6 so as to transfer the portion of the roll sheet 2 in the progressive (winding) direction. The progressive mechanism 32 includes a pulley 41 that is a first gear, a second gear 42, a third gear 43, a fourth gear 44, and a fifth gear 45. The first gear or the pulley 41 is provided on a shaft differing from a shaft of the DC motor 31 so that drive force is transmitted between the pulley 41 and the DC motor 31. The second gear 42 is provided on the same shaft as the pulley 41 of the first gear. The third gear 43 is provided on a shaft differing from the shaft of the second gear 42 so that drive force is transmitted between the third gear 43 and the second gear 42. The fourth gear 44 is provided on the same shaft as the third gear 43. The fifth gear 45 is provided on a same shaft of the sheet-feeding roller 6 differing from the shaft of the fourth gear 44 .so that drive force is transmitted between the fourth gear 44 and the sheet-feeding roller 6.

The roll-sheet drive mechanism 33 (see FIG. 2) transmits drive force to the roll sheet 2. The roll-sheet drive mechanism 33 receives drive force of the progressive (winding) direction when the roll sheet 2 is transferred in the progressive (winding) direction. Further, the roll-sheet drive mechanism 33 transmits drive force to the roll sheet 2 via the rewinding roller 4, the intermediate rolls 25, and the flange members 1 so as to rewind a rolled out portion of the roll sheet 2. The roll-sheet drive mechanism 33 includes a sixth gear 46, a seventh gear 47, an eighth gear 48, a ninth gear 49, and a torque limiter 36. The sixth gear 46 is provided on the same shaft as the rewinding gear 4 (see FIG. 2). The seventh gear 47 is provided on a shaft differing from the shaft of the sixth gear 46 so that drive force is transmitted between the seventh gear 47 and the sixth gear 46. The eighth gear 48 is provided on the same shaft as the seventh gear 47. The ninth gear 49 is provided on a shaft differing from the shaft of the eighth gear 48 so that drive force is transmitted between the ninth gear 49 and the eighth gear 48.

The torque limiter 36 includes an input shaft 38, an output shaft 37, and a rotational load generating unit (not shown) generating rotational load between the input shaft 38 and the output shaft 37. The input shaft 38 is a rotational shaft provided inside (inner side) of the torque limiter 36. The output shaft 37 is a rotational case provided outside (outer side) of the torque limiter 36. The inner side of the torque limiter 36 where the input shaft 38 is provided is called an "input side" of the torque limiter 36, whereas the outer side of the torque limiter 36 where the output shaft 37 is provided is called an "output side" of the torque limiter 36. However, note that the input shaft and the output shaft are defined based on the structure of the torque limiter and may not be limited to the above definitions. The rotational drive force may be input from the output shaft 37 and output from the input shaft 38 via the rotational load generating unit (not shown). In this embodiment, when the roll sheet 2 is progressively transferred, the rotational drive force transmitted from the roll sheet 2 is input to the output shaft 37 of the torque limiter 36 via the rewinding roller 4, and the input rotational drive force is then output from the input shaft 38 via the unshown rotational load generating unit to the progressive mechanism 32 side. By contrast, when the roll sheet 2 is rewound, the rotational drive force transmitted from the DC motor 31 is input to the input shaft 38 of the torque limiter 36 via a high rotational pulley 52, and the input rotational drive force is then output from the output shaft 37 via the unshown rotational load generating unit to the roll sheet 2 side.

The output shaft 37 of the torque limiter 36 and the ninth gear 49 are uniformly arranged so as to rotate in an integrated manner. The input shaft 38 of the torque limiter 36 is provided such that the input shaft 38 of the torque limiter 36 transmits drive force to the progressive mechanism 32 via the regenerating mechanism 34, or receives the drive force from the progressive mechanism 32 via the rewinding mechanism 35.

The torque limiter 36 is the rotational load generating mechanism generating the rotational load. The torque limiter 36 applies, when the sheet-feeding roller 6 intermittently transfers the roll sheet 2 in the progressive (winding) direction, pulling force to the roll sheet 2 in the rewinding direction to prevent the roll sheet 2 from being excessively transferred, resulting in loosening the roll sheet 2. That is, transfer load is applied to a sheet portion rolled out from the roll sheet 2 in the progressive (winding) direction based on the rotational load generated from the torque limiter 36.

The roll-sheet drive mechanism 33 receives the drive force via the portion of roll sheet 2 transferred in the progressive (winding) direction, and transmits the received drive force to the progressive mechanism 32. The regenerating mechanism 34 regenerates the transmitted drive force as another drive force in addition to the drive force from the drive source 31. The first clutch-fitting pulley 51 is provided on the input shaft 38 of the torque limiter 36 so that the drive force is transmitted between the pulley 41 that is the first gear of the progressive mechanism 32 and the first clutch-fitting pulley 51. A first one-way clutch 51*a* (see FIG. 5) is provided in the first clutch-fitting pulley 51 so as to be locked in the input shaft 38 of the torque limiter 36 when the first clutch-fitting pulley 51 relatively rotates in the rewinding direction, or so as to slip on the input shaft 38 of the torque limiter 36 when the first clutch-fitting pulley 51 relatively rotates in the progressive (winding) direction.

Further, the rewinding mechanism 35 transmits a drive force to rewind the rolled out portion of the roll sheet 2 via the rewinding roller 4, the intermediate rolls 25, and the flange members 1 to the roll sheet 2. That is, the rewinding mechanism 35 transfers (i.e., rewinds) the portion of the roll sheet 2 via the roll-sheet drive mechanism 33 in a direction opposite to the progressive (winding) direction. The rewinding mechanism 35 includes a second clutch-fitting pulley 52. The second clutch-fitting pulley 52 is also provided on the input shaft 38 of the torque limiter 36 so that the drive force is transmitted between the pulley 41 that is the first gear of the progressive mechanism 32 and the second clutch-fitting pulley 52.

A second one-way clutch 52*a* (see FIG. 5) is provided in the second clutch-fitting pulley 52 so that the second one-way clutch 52*a* can be switched to be locked or to slip on the input shaft 38 of the torque limiter 36. The second one-way clutch 52*a* (see FIG. 5) is provided in the second clutch-fitting pulley 52 so as to be locked in the input shaft 38 of the torque limiter 36 when the second clutch-fitting pulley 52 relatively rotates in the rewinding direction, or so as to slip on the input shaft 38 of the torque limiter 36 when the second clutch-fitting pulley 52 relatively rotates in the progressive (winding) direction.

With such configurations, the drive source 31 according to the embodiment can carry out a progressive operation and a rewinding operation via the roll-sheet drive mechanism 33. The rewinding mechanism 35 and the regenerating mechanism 34 can be switched based on the rotational directions of the drive source 31; that is, the rewinding mechanism 35 is activated when the drive source 31 rotates in the progressive (winding) direction while the regenerating mechanism 34 is activated when the drive source 31 rotates in the rewinding direction.

Note that the speed reduction ratio of the first clutch-fitting pulley 51 to the pulley 41 of the first gear is larger than that of the second clutch-fitting pulley 52 to the pulley 41 of the first gear. That is, the speed reduction ratio of the first clutch-fitting pulley 51 to the DC motor 31 is larger than that of the second clutch-fitting pulley 52 to the DC motor 31. In the following description, the first clutch-fitting pulley 51 is also referred to as a "first clutch-fitting pulley (low rotation pulley)" and the second clutch-fitting pulley 52 is also referred to as a "second clutch-fitting pulley (high rotation pulley)".

Note that the first clutch-fitting pulley 51 corresponds to a first pulley or the first gear and the second clutch-fitting pulley 52 corresponds to a second pulley or the second gear. Note also that in the following description, the first clutch-fitting pulley 51 and the second clutch-fitting pulley 52 are described as "pulleys"; however, they are not limited to the pulleys but may be "gears".

Figure 3:
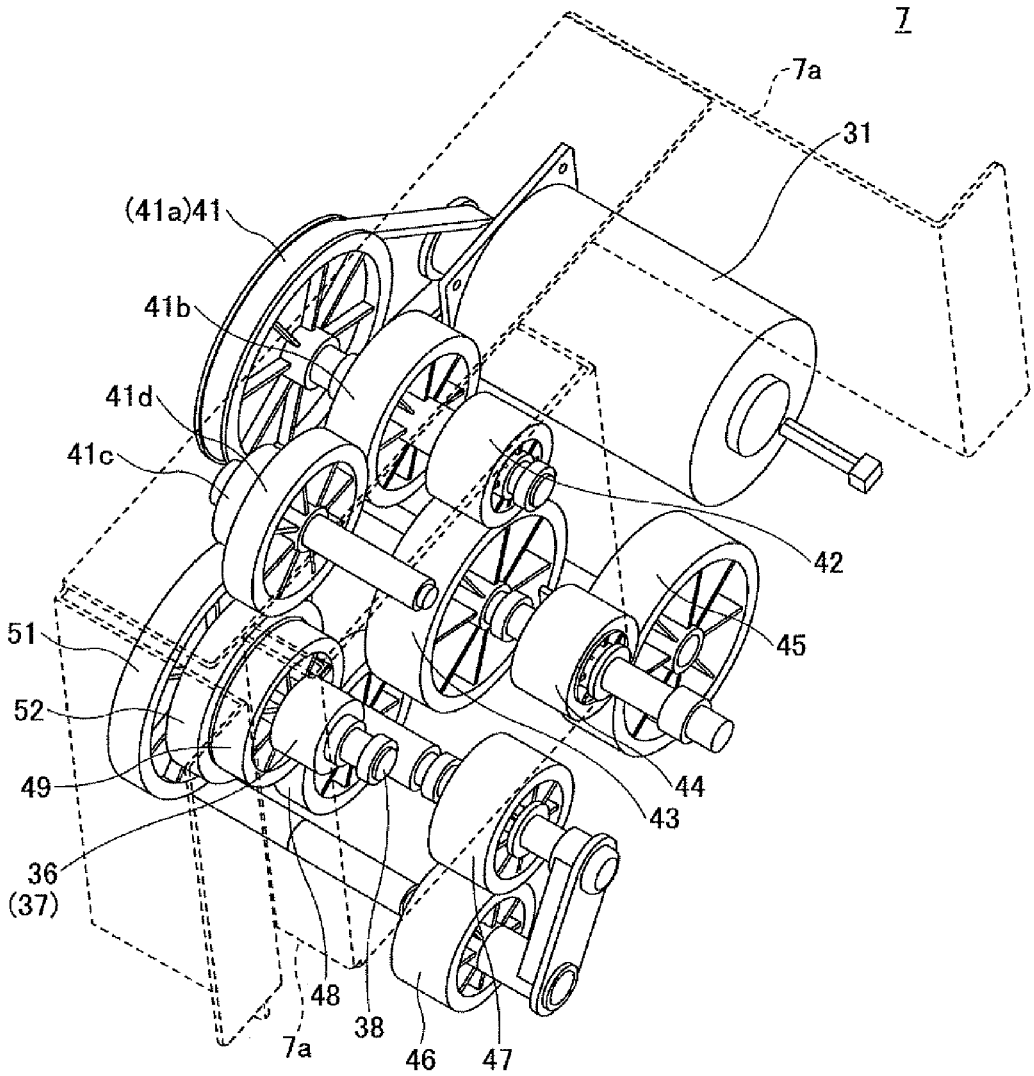
FIG. 3 is a first perspective view illustrating a regenerating mechanism and a rewinding mechanism of the drive unit of the roll-sheet feeding device according to the embodiment.
Figure 4:
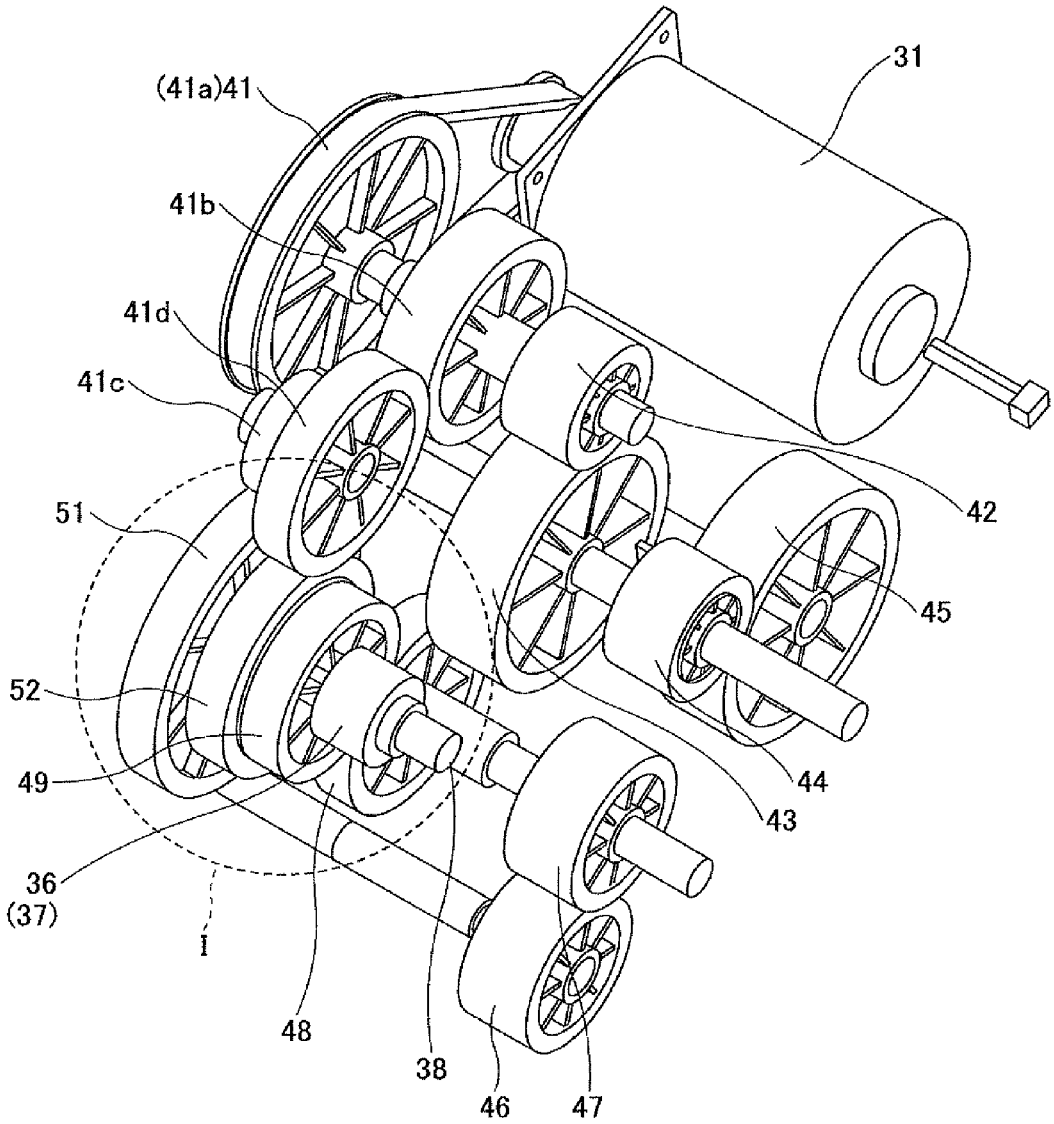
FIG. 4 is a second perspective view illustrating a regenerating mechanism and a rewinding mechanism of the drive unit of the roll-sheet feeding device according to the embodiment.

As illustrated in FIGS. 3 and 4, the drive source 31, the progressive mechanism 32, the roll-sheet drive mechanism 33, and the rewinding mechanism 35 are uniformly arranged and supported in a drive unit case 7*a*. The pulley 41 that is the first gear, the second year 42, the third gear 43, the fourth gear 44, and the fifth gear 45 are uniformly arranged and supported in the drive unit case 7*a* as the progressive mechanism 32. The sixth gear 46, the seventh gear 47, the eighth gear 48, the ninth gear 49, and the torque limiter 36 are uniformly arranged and supported in the drive unit case 7*a* as the roll-sheet drive mechanism 33. The first clutch-fitting pulley 51 is arranged in the drive unit case 7*a* as the regenerating mechanism 34. The second clutch-fitting pulley 52 is arranged in the drive unit case 7*a* as the rewinding mechanism 35.

The first pulley 41 of the first gear of the progressive mechanism 32 includes the first pulley 41*a* (i.e., the first pulley 41), a tenth gear 41*b*, an eleventh gear 41*c*, and a twelfth gear 41*d*. The first pulley 41*a* is provided on the shaft differing from the shaft of the DC motor 31 so that the drive force is transmitted between the pulley 41*a* and the DC motor 31. The tenth gear 41*b* is provided on the same shaft as the first pulley 41*a* and the second gear 42. The eleventh gear 41*c* is provided on a shaft differing from the shaft of the tenth gear 41*b* so that drive force is transmitted between the eleventh gear 41*c* and the tenth gear 41*b*. The twelfth gear 41*d* is provided on the same shaft as the eleventh gear 41*c*.

Further, the speed reduction ratio of the first clutch-fitting pulley 51 to the drive source 31 is larger than that of the second clutch-fitting pulley 52 to the drive source 31. Therefore, the speed reduction ratio of the first clutch-fitting pulley 51 to the eleventh gear 41*c* is larger than that of the second clutch-fitting pulley 52 to the twelfth gear 41*d*. As illustrated in FIGS. 3 and 4, a diameter (i.e., the number of gear teeth) of the first clutch-fitting pulley (gear) 51 is configured to be larger than that (those) of the second clutch-fitting pulley 52, while the number of gear teeth of the eleventh gear 41*c* is configured to be smaller than those of the twelfth gear 41*d*.

Next, a progressive operation conducted by the drive unit 7 that transfers the roll sheet in the progressive (winding) direction is described.

In the progressive operation, the second one-way clutch 52*a* fitting in the second clutch-fitting pulley 52 is configured to slip on the input shaft 38 of the torque limiter 36, so that the drive force in the progressive (winding) direction of the DC motor 31 is not transmitted from the progressive mechanism 32 to the roll sheet 2 via the rewinding mechanism 35 and the roll-sheet feeding mechanism 33.

The rotational drive force of the DC motor 31 in the progressive (winding) direction is transmitted to the roll sheet 2 in the order via the first gear or pulley 41 of the progressive mechanism 32, the second gear 42, the third gear 43, the fourth gear 44, the fifth gear 45, and the sheet-feeding roller 6 as indicated by solid arrows in FIG. 2. The drive force transmitted to the roll sheet 2 is transmitted via the flange members 1, the intermediate rolls 25, and the rewinding roller 4, which is finally applied (transmitted) to the output shaft 37 of the torque limiter 36 in the order via the sixth gear 46, the seventh gear 47, the eighth gear 48, and the ninth gear 49 of the roll-sheet drive mechanism 33 as indicated by dashed arrows in FIG. 2.

Note that the rotational speed of the first clutch-fitting pulley 51 is configured to be constantly slower than that of the output shaft 37 of the torque limiter 36 as will be described later. Therefore, the rotation of the input shaft 38 of the torque limiter 36 overtakes that of the first clutch-fitting pulley 51, and the first one-way clutch 51*a* fitting in the first clutch-fitting pulley 51 is locked in the input shaft 38 of the torque limiter 36. Consequently, the rotational load of the torque limiter 36 is generated due to the difference in the rotational speed between the input shaft 38 and the output shaft 37 of the torque limiter 36.

In this embodiment, the rotational load of the torque limiter 36 is used as brake force to cancel out the inertia of the roll sheet 2, and at the same time, can be transmitted to the progressive mechanism 32 to regenerate the transmitted rotational load as another drive force in addition to the drive force from the drive source 31. That is, the rotational drive force applied to the output shaft 37 of the torque limiter 36 is transmitted to the input shaft 38 of the torque limiter 36 in an amount corresponding to the rotational load generated by the torque limiter 36. The rotational drive force transmitted to the input shaft 38 of the torque limiter 36 is transmitted to the first clutch-fitting pulley 51 via the first one-way clutch 51*a*, because the first one-way clutch 51*a* in the first clutch-fitting pulley 51 is locked in the input shaft 38 as described above. The rotational drive force transmitted to the first clutch-fitting pulley 51 is transmitted to the progressive mechanism 32. The transmitted rotational drive force is then regenerated to be used as another drive force in addition to the drive force from the DC motor 31.

Next, a description is given of a rewinding operation in which the rolled out portion of the roll sheet 2 is transferred in the rewinding direction to be rewound on the roll sheet 2.

When the rewinding operation is conducted, the first one-way clutch 51*a* fitting in the first clutch-fitting pulley 51 is configured to slip on the input shaft 38 of the torque limiter 36, so that the drive force in the progressive (winding) direction of the DC motor 31 is not transmitted from the progressive mechanism 32 to the roll sheet 2 via the rewinding mechanism 35 and the roll-sheet feeding mechanism 33.

In the rewinding operation, the rotational drive force of the DC motor 31 in the rewinding direction is transmitted in the order via the first gear or pulley 41 of the progressive mechanism 32, the second clutch-fitting pulley 52 of the rewinding mechanism 35, the torque limiter 36, the ninth gear 49, the eighth gear 48, the seventh gear 47, the sixth gear 46, which is then finally transmitted to the roll sheet 2 via the rewinding roller 4, the intermediate rolls 25, and the flange members 1 as indicated by dashed arrows in FIG. 2. Note that the second one-way clutch 52*a* that is locked in the input shaft 38 of the torque limiter 36 will be described later.

Simultaneously, the rotational drive force of the DC motor 31 in the rewinding direction is transmitted to the roll sheet 2 in the order via the first gear or pulley 41 of the progressive mechanism 32, the second gear 42, the third gear 43, the fourth gear 44, the fifth gear 45, and the sheet-feeding roller 6 as indicated by dashed arrows in FIG. 2.

Note that the rotational speed of the second clutch-fitting pulley 52 is configured to be faster than that of the output shaft 37 of the torque limiter 36 as will be described later. Therefore, the rotation of the second clutch-fitting pulley 52 overtakes that of the input shaft 38 of the torque limiter 36, and the second one-way clutch 52*a* fitting in the second clutch-fitting pulley 52 is locked in the input shaft 38 of the torque limiter 36.

Further, in the torque limiter 36, the output shaft 37 of the torque limiter 36 can be configured to slip on the input shaft 38 of the torque limiter 36 such that the rotational speed of the output shaft 37 of the torque limiter 36 is lower than that of the input shaft 38 of the torque limiter 36. As a result, the output shaft 37 of the torque limiter 36 is configured to rotate at a rotational speed such that the rolled out portion of the roll sheet 2 can maintain a constant tension between the sheet-feeding roller 6 and the roll sheet 2, thereby preventing the rolled out portion of the roll sheet 2 from loosening.

Figure 5:
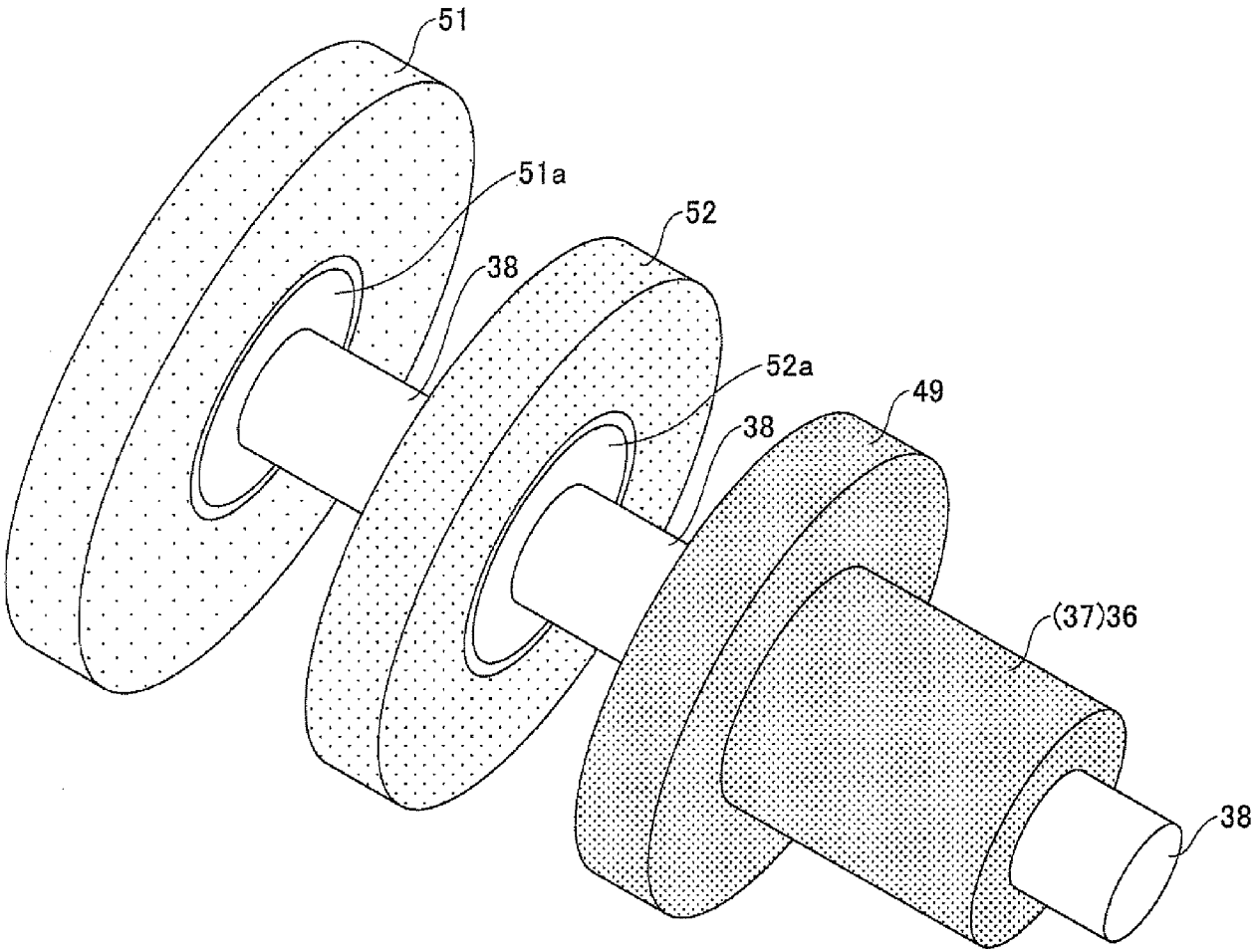
FIG. 5 is an enlarged perspective view illustrating a periphery of the regenerating mechanism and the rewinding mechanism in FIG. 4.
Figure 6:
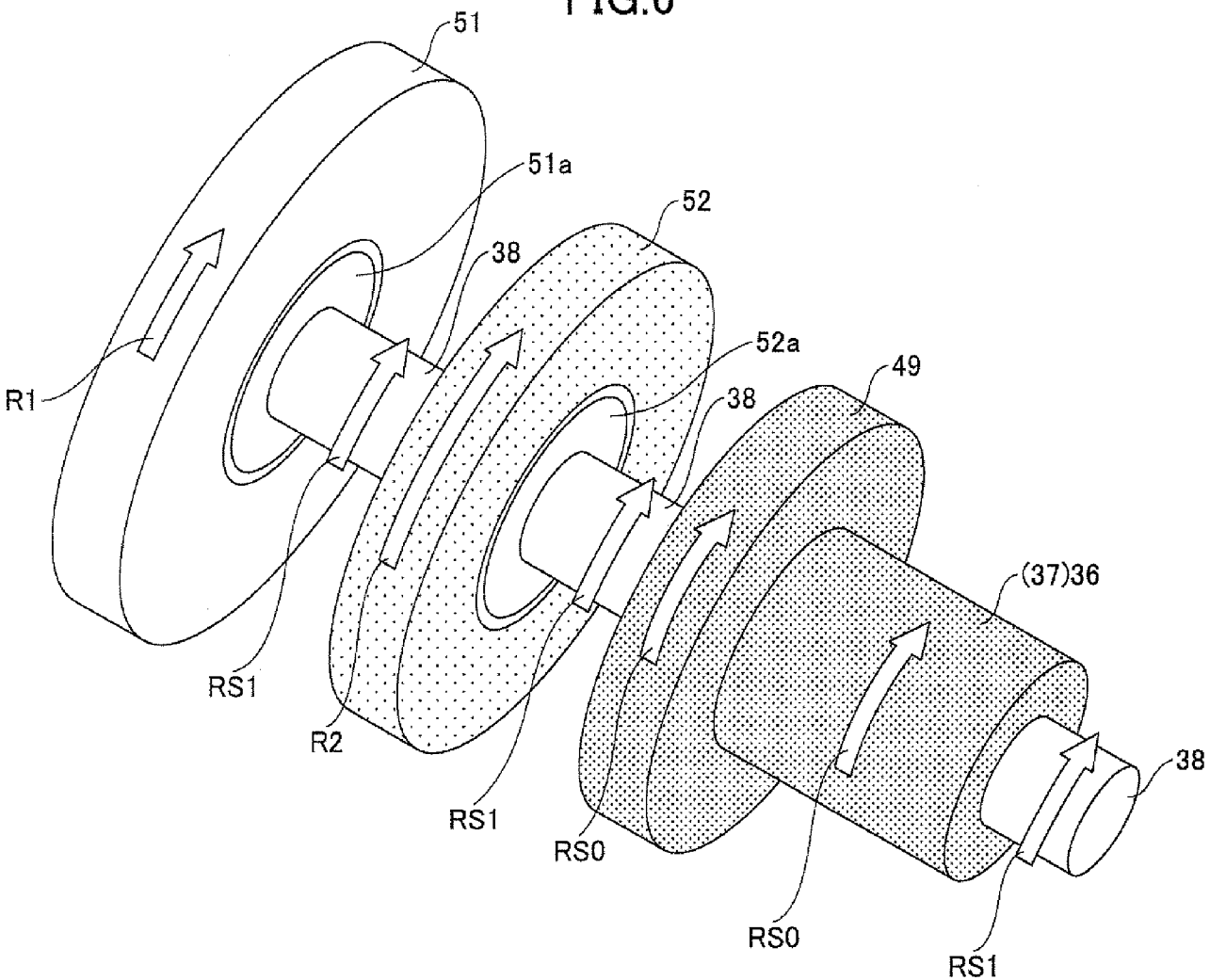
FIG. 6 is a perspective view illustrating a relationship between a rotational direction and a rotational speed of the regenerating mechanism and that of the rewinding mechanism while the roll-sheet feeding device according to the embodiment transfers the roll sheet in a progressive (winding) direction.
Figure 7:
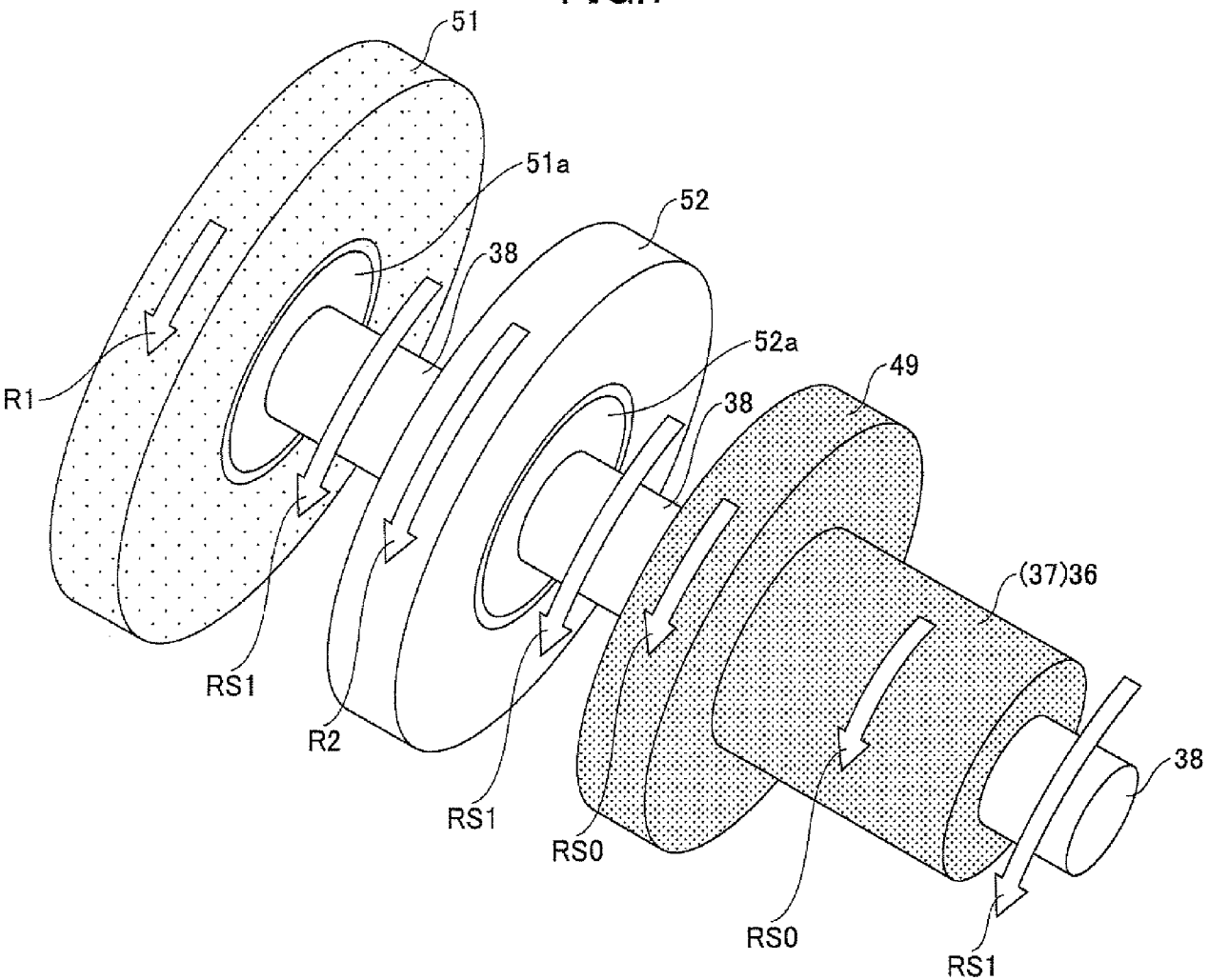
FIG. 7 is a perspective view illustrating a relationship between a rotational direction and a rotational speed of the regenerating mechanism and that of the rewinding mechanism while the roll-sheet feeding device according to the embodiment rewinds the roll sheet in a rewinding direction.

Next, effects of regeneration of the drive force in the drive unit according to the embodiment are described with reference to FIGS. 2 through 5. FIG. 5 is an enlarged perspective view illustrating a peripheral area of the regenerating mechanism and the rewinding mechanism in FIG. 4. FIG. 5 is the enlarged perspective view illustrating the periphery of the first and second one-way clutches and the torque limiter enclosed by a broken line I in FIG. 4. FIG. 6 is a perspective view illustrating a relationship between a rotational direction and a rotational speed of the regenerating mechanism and that of the rewinding mechanism while the roll-sheet feeding device according to the embodiment transfers the roll sheet in the progressive (winding) direction (hereinafter also called a "progressive operation"). FIG. 7 is a perspective view illustrating a relationship between a rotational direction and a rotational speed of the regenerating mechanism and that of the rewinding mechanism while the roll-sheet feeding device according to the embodiment rewinds the roll sheet in the rewinding direction.

In the progressive operation, drive force to rotate in the progressive (winding) direction indicated by a rightwards thick arrow in FIG. 2 is supplied to the sheet-feeding roller 6.

In the progressive operation, since the second one-way clutch 52*a* fitting in the second clutch-fitting pulley 52 is configured to slip on the input shaft 38 of the torque limiter 36, the drive force is not transmitted between the roll-sheet feeding mechanism 33 and the progressive mechanism 32 via the rewinding mechanism 35. Consequently, the drive force is not transmitted from the DC motor 31 to the rewinding roller 4 via the rewinding mechanism 35.

In contrast, the first one-way clutch 51*a* fitting in the first clutch-fitting pulley 51 is configured to be locked in the input shaft 38 of the torque limiter 36, so that the drive force is transmitted between the roll-sheet feeding mechanism 33 and the progressive mechanism 32 via the regenerating mechanism 34. Note that the rotational drive force is applied to the output shaft 37 of the torque limiter 36 of the load generating mechanism by the rolled out portion of the roll sheet 2 transferred by the sheet-feeding roller 6 that is rotationally driven by the progressive mechanism 32, and the rewinding roller 4 that is rotated via the flange members 1 and the intermediate rolls 25. The rotational drive force applied to the output shaft 37 of the torque limiter 36 is transmitted to the input shaft 38 of the torque limiter 36 in an amount corresponding to the rotational load generated by the torque limiter 36. The rotational drive force transmitted to the input shaft 38 of the torque limiter 36 is transmitted to the first clutch-fitting pulley 51 via the first one-way clutch 51*a*, because the first one-way clutch 51*a* in the first clutch-fitting pulley 51 is locked in the input shaft 38 as described above. Since the rotational speed of the first clutch-fitting pulley 51 is controlled by the torque limiter 36, the rotation of the first clutch-fitting pulley 51 is synchronized with the rotation of the progressive mechanism 32. Accordingly, the rotational drive force of the first clutch-fitting pulley 51 is transmitted to the progressive mechanism 32. Part of the drive force transmitted to the roll-sheet feeding mechanism 33 via the transferred (rolled out) portion of the roll sheet 2 is transmitted to the progressive mechanism 32 via the first one-way clutch 51*a* and the first clutch-fitting pulley 51, which is then regenerated and used as another drive force in addition to the drive force from the DC motor 31.

While the torque limiter 36 is responsible for partially regenerating another drive force as described above, the torque limiter 36 also plays a role in cancelling out an excess amount of the drive force if the drive force applied via the transferred (rolled out) portion of the roll sheet 2 is excessive. That is, the torque limiter 36 provides brake force to cancel out a progressive force generated due to the inertia that causes the roll sheet 2 to rotate in the progressive (winding) direction despite the fact that the intermittent transfer of the roll sheet 2 is deactivated.

Note that the first clutch-fitting pulley (low rotation pulley) 51 having the first one-way clutch 51*a* is configured to have the speed reduction ratio such that the first clutch-fitting pulley (low rotation pulley) 51 rotates at a rotational speed constantly lower than that of the output shaft 37 of the torque limiter 36 that is supplied with the rotational drive from the transferred portion of the roll sheet 2.

Specific descriptions are given below with reference to TABLE 1 and TABLE 2.

TABLE 1 illustrates rotational speeds of respective components in the progressive operation. In TABLE 1, the "maximum remaining amount" represents the maximum amount (length) of sheet rolled in the roll sheet 2, whereas the "minimum remaining amount" represents the minimum amount (length) of sheet rolled in the roll sheet 2. Note also that in TABLE 1, the rotational speed in the progressive (winding) direction is expressed by a positive number whereas the rotational speed in the rewinding direction is expressed by a negative number.

TABLE 1

| NAME OF COMPONENT OR RELATIVE ROTATION | NOTATION OF COMPONENT OR RELATIVE ROTATION | ROTATIONAL SPEED (rpm) | CLUTCH STATUS |
|---|---|---|---|
| DC MOTOR | RM | 2023 | NA |
| LOW ROTATION PULLEY | R1 | 285 | NA |
| HIGH ROTATION PULLEY | R2 | 700 | NA |
| TORQUE LIMITER OUTPUT SHAFT (MAXIMUM REMAINING AMOUNT) | RS0 | 685 | NA |
| TORQUE LIMITER OUTPUT SHAFT (MINIMUM REMAINING AMOUNT) | RS0 | 291 | NA |
| RELATIVE ROTATION OF LOW ROTATION PULLEY RELATIVE TO TORQUE LIMITER OUTPUT SHAFT (MAXIMUM REMAINING AMOUNT) | R1 − RS0 | −400 | LOW ROTATION PULLEY LOCKED |
| RELATIVE ROTATION OF HIGH ROTATION PULLEY RELATIVE TO TORQUE LIMITER OUTPUT SHAFT (MAXIMUM REMAINING AMOUNT) | R2 − RS0 | 15 | HIGH ROTATION PULLEY SLIPPED |
| TORQUE LIMITER INPUT SHAFT (MAXIMUM REMAINING AMOUNT) | RS1 | 285 | NA |
| RELATIVE ROTATION OF LOW ROTATION PULLEY RELATIVE TO TORQUE LIMITER OUTPUT SHAFT (MINIMUM REMAINING AMOUNT) | R1 − RS0 | −6 | LOW ROTATION PULLEY LOCKED |
| RELATIVE ROTATION OF HIGH ROTATION PULLEY RELATIVE TO TORQUE LIMITER OUTPUT SHAFT (MINIMUM REMAINING AMOUNT) | R2 − RS0 | 409 | HIGH ROTATION PULLEY SLIPPED |
| TORQUE LIMITER INPUT SHAFT (MINIMUM REMAINING AMOUNT) | RS1 | 285 | NA |

As illustrated in TABLE 1, when a rotational speed RM of the DC motor 31 is 2023 rpm, a rotational speed R1 of the first clutch-fitting pulley (low rotation pulley) 51 is 285 rpm, and a rotational speed R2 of the second clutch-fitting pulley (high rotation pulley) 52 is 700 rpm. At this moment, the speed reduction ratios are set such that a rotational speed RS0 of the output shaft 37 of the torque limiter 36, which is rotated by the drive force in the progressive (winding) direction obtained from the rolled out portion of the roll sheet 2 transferred in the progressive (winding) direction via the sheet-feeding roller 6, is set at 685 rpm when a diameter of the roll sheet 2 is largest (i.e., the maximum remaining amount), while the rotational speed RS0 of the output shaft 37 is set at 291 rpm when a diameter of the roll sheet 2 is smallest (i.e., the minimum remaining amount).

Note that the input shaft 38 of the torque limiter 36 is locked in or slips on the first clutch-fitting pulley (low rotation pulley) 51 or the second clutch-fitting pulley (high rotation pulley) 52, and also receives rotational load generated by the torque limiter 36. Accordingly, a rotational speed RS1 of the input shaft 38 of the torque limiter 36 may beset at a mid value between the minimum value and maximum value of the rotational speeds R1, R2, and RS0 of the first clutch-fitting pulley (low rotation pulley) 51, the second clutch-fitting pulley (high rotation pulley) 52, and the output shaft 37 of the torque limiter 36. In this case, R1 (=285 rpm)≦RS1≦R2 (=700 rpm).

As illustrated in TABLE 1, when the diameter of the roll sheet 2 is largest (i.e., the maximum remaining amount), a relative rotational speed R1−RS0 of the first clutch-fitting pulley (low rotation pulley) 51 to the rotational speed RS0 of the output shaft 37 of the torque limiter 36 results in: R1−RS0=285−685=−400 rpm<0. In this case, since the first clutch-fitting pulley (low rotation pulley) 51 also has a rotational speed relatively in the rewinding direction (i.e., negative direction) to the rotational speed RS1 of the input shaft 38 of the torque limiter 36, the first clutch-fitting pulley (low rotation pulley) 51 is locked by the first one-way clutch 51*a*.

In contrast, a relative rotational speed R2−RS0 of the second clutch-fitting pulley (high rotation pulley) 52 to the rotational speed RS0 of the output shaft 37 of the torque limiter 36 results in: R2−RS0=700−685=15 rpm>0. In this case, since the second clutch-fitting pulley (high rotation pulley) 52 also has a rotational speed relatively in the progressive (winding) direction (i.e., positive direction) to the rotational speed RS1 of the input shaft 38 of the torque limiter 36, the second clutch-fitting pulley (high rotation pulley) 52 is slipped from the second one-way clutch 51*a*.

Accordingly, the rotational speed RS1 of the input shaft 38 of the torque limiter 36 results in: RS1=R1=285 rpm.

Further, when the diameter of the roll sheet 2 is smallest (i.e., the minimum remaining amount), the relative rotational speed R1−RS0 of the first clutch-fitting pulley (low rotation pulley) 51 to the rotational speed RS0 of the output shaft 37 of the torque limiter 36 results in: R1−RS0=285−291=−6 rpm<0. In this case, since the first clutch-fitting pulley (low rotation pulley) 51 also has a rotational speed relatively in the rewinding direction (i.e., negative direction) to the rotational speed RS1 of the input shaft 38 of the torque limiter 36, the first clutch-fitting pulley (low rotation pulley) 51 is locked by the first one-way clutch 51*a*.

In contrast, the relative rotational speed R2−RS0 of the second clutch-fitting pulley (high rotation pulley) 52 to the rotational speed RS0 of the output shaft 37 of the torque limiter 36 results in: R2−RS0=700−291=409 rpm>0. In this case, since the second clutch-fitting pulley (high rotation pulley) 52 also has a rotational speed relatively in the progressive (winding) direction (i.e., positive direction) to the rotational speed RS1 of the input shaft 38 of the torque limiter 36, the second clutch-fitting pulley (high rotation pulley) 52 is slipped from the second one-way clutch 51*a*.

Accordingly, the rotational speed RS1 of the input shaft 38 of the torque limiter 36 results in: RS1=R1=285 rpm.

As described above, the regenerating mechanism 34 may be operated when the rotational speed RS0 of the output shaft 37 of the torque limiter 36 is equal to or higher than the rotational speed R1 of the first clutch-fitting pulley (low rotation pulley) 51 and equal to or lower than the rotational speed R2 of the second clutch-fitting pulley (high rotation pulley) 52. In transferring the roll sheet 2 in the progressive (winding) direction, the first one-way clutch 51*a* and the second one-way clutch 52*a* can be switched when the rotational speed RS0 of the output shaft 37 of torque limiter 36 (first load generating mechanism) is higher than the rotational speed R1 of the first clutch-fitting pulley (or a gear) 51.

If relationships of the above described speed reduction ratios are satisfied, the first clutch-fitting pulley (low rotation pulley) 51 having the first one-way clutch 51*a* rotates at a rotational speed constantly lower than the rotational speed RS0 of the output shaft 37 of the torque limiter 36 that is supplied with the rotational drive from the transferred portion of the roll sheet 2. Accordingly, the first one-way clutch 51*a* alone is locked in the input shaft 38 of the torque limiter 36, and thus the rotational drive force transmitted to the input shaft 38 of the torque limiter 36 is transmitted to the first clutch-fitting pulley 51 via the first one-way clutch 51*a*. Specifically, although the drive force of the DC motor 31 is not transmitted via the first clutch-fitting pulley (low rotation pulley) 51 or the first one-way clutch 51*a* to the roll-sheet drive mechanism 32, the rotation of the first clutch-fitting pulley (low rotation pulley) 51 is caught up with rotation of the input shaft 38 of the torque limiter 36 to cause the first one-way clutch 51*a* to be locked in the input shaft 38 of the torque limiter 36, thereby obtaining the rotational drive force in an amount corresponding to the rotational load generated by the torque limiter 36. The obtained rotational drive force is then transmitted to the progressive mechanism 32 via from the first one-way clutch 51*a*. As a result, in the progressive mechanism 32, the transmitted rotational drive force is used as another drive force in addition to the drive force from the DC motor 31.

In this embodiment, the above example is given of a case where the rotational speed RS0 of the output shaft 37 of the torque transmitter 36 that is the first load generating mechanism is lower than the rotational speed R2 of the second clutch-fitting pulley (or gear) that is rotationally driven by the DC motor 31 that is the drive source. However, the rotational speed RS0 of the output shaft 37 of the torque transmitter 36 may be equal to or higher than the rotational speed R2 of the second clutch-fitting pulley (or gear), and the transmitted rotational drive force is still regenerated as another drive force in addition to the drive force from the DC motor 31.

In contrast, in the rewinding operation, the drive force to rotate the roll sheet 2 in the rewinding direction opposite to the progressive (winding) direction indicated by a leftwards thick dashed arrow in FIG. 2 is supplied to the sheet-feeding roller 6.

In this case, the first clutch-fitting pulley 51 (low rotation pulley) is configured to slip on the input shaft 38 of the torque limiter 36, so that the drive force is not transmitted between the roll-sheet feeding mechanism 33 and the progressive mechanism 32 via the regenerating mechanism 34. Consequently, the drive force is not transmitted from the DC motor 31 to the rewinding roller 4 via the regenerating mechanism 34.

In the rewinding operation, since the second one-way clutch 52*a* fitting in the second clutch-fitting pulley 52 (high rotation pulley) is configured to be locked in the input shaft 38 of the torque limiter 36, the drive force is transmitted between the roll-sheet feeding mechanism 33 and the progressive mechanism 32 via the rewinding mechanism 35. Accordingly, the rewinding roller 4 is rotated in the rewinding direction via the second clutch-fitting pulley 52 (high rotation pulley) rotationally driven by the progressive mechanism 32 and the torque limiter 36.

Similar to the progressive operation, the rotational speed RS0 of the output shaft 37 of the torque limiter 36 is set in advance for corresponding diameter ranges of the roll sheet 2 such that the rotational speed RS0 (absolute value) of the output shaft 37 of the torque limiter 36 is equal to or higher than the rotational speed R1 (absolute value) of the first clutch-fitting pulley 51 (low rotation pulley) in the rewinding operation. The rotational speed in the rewinding operation is opposite to that in the progressive operation, so that the second clutch-fitting pulley (high rotation pulley) 52 also has a rotational speed relatively in the rewinding direction (i.e., negative direction) to the rotational speed RS1 of the input shaft 38 of the torque limiter 36, the second clutch-fitting pulley (high rotation pulley) 52 is locked in the second one-way clutch 51*a*. Accordingly, the rotational speed RS1 of the input shaft 38 of the torque limiter 36 equals the rotational speed R2 of the second clutch-fitting pulley (high rotation pulley) 52. In contrast, since the first clutch-fitting pulley (low rotation pulley) 51 has a rotational speed relatively in the progressive (winding) direction (i.e., positive direction) to the rotational speed RS1 of the input shaft 38 of the torque limiter 36, the first clutch-fitting pulley rotation pulley) 51 is slipped from the first one-way clutch 51*a*.

With the above rewinding operation, the roll sheet 2 can be rewound without the looseness between the sheet-feeding roller 6 and the roll sheet 2.

Figure 8:
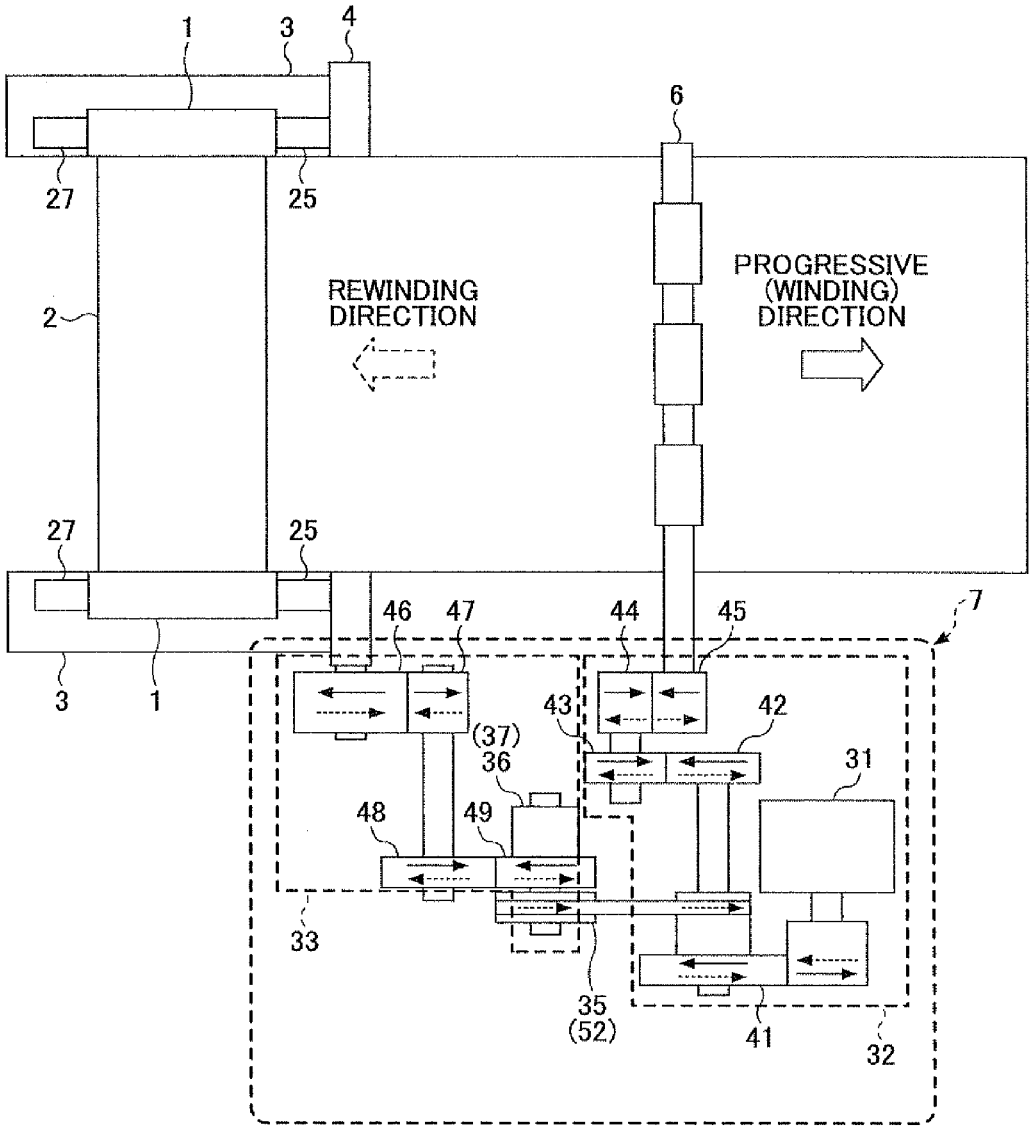
FIG. 8 is a diagram schematically illustrating a configuration of a drive unit of a roll-sheet feeding device according to the related art.

In contrast, the roll-sheet feeding device having the related art drive unit without a regenerating mechanism described in the embodiment may not provide an effect of regenerating the rotational drive force as another drive force in addition to the drive force from the drive source. FIG. 8 is a diagram schematically illustrating a configuration of the drive unit of the roll-sheet feeding device according to the related art.

As illustrated in FIG. 8, there are no first clutch-fitting pulley (low rotation pulley) 51, nor first one-way clutch 51*a* provided in the related art drive unit. In the related art drive unit, there is provided between the roll-sheet drive mechanism 33 and the progressive mechanism 32 one second clutch-fitting pulley 52 only that includes the second one-way clutch 52*a* configured to slip from the second clutch-fitting pulley 52 in the progressive operation.

Further, the related art drive unit is configured such that the eighth gear 48 is coupled with an input shaft of a brake force generating torque transmitter provided on a different shaft from the eight gear 48 via an electromagnetic clutch (not shown) that is capable of determining (switching) whether or not to transmit the drive force to the eighth gear 48 to secure the output shaft of the brake force generating torque transmitter. In the progressive operation, the eighth gear 48 is connected to the electromagnetic clutch (not shown) to transmit the rotational driving force from the eighth gear 48 to the brake generating torque limiter (now shown), and the drive force provided in the roll-sheet drive mechanism 33 is secured based on the rotational load generated by the brake force generating torque limiter. In the rewinding operation, the electromagnetic clutch (not shown) is disconnected from the eighth gear 48 so as not to transmit the rotational driving force from the eighth gear 48 to the brake generating torque limiter (now shown). In the roll-sheet feeding device having the drive unit according to the related art configuration, energy provided via the drive force via the roll sheet to rotationally drive the brake generating torque limiter is only consumed as friction heat inside the brake force generating torque limiter so that the energy to rotationally drive the brake generating torque limiter is not transmitted to the progressive mechanism 32 to be used as another drive force in addition to the drive force from the DC motor 31.

Finally, the experimental data illustrating the effect obtained in the application of the embodiment is described. The roll sheet was placed in the roll-sheet feeding device, and the torque gauge was used to measure torque of the DC 31 on the rotational shaft. A torque limiter having the torque limiter value of 1000 gfcm was used. TABLE 2 illustrates the results of the torque of the DC motor 31 measured in the drive unit of the drive according to the embodiment and the drive unit according to related art.

TABLE 2

| MEASUREMENT CONDITION | TORQUE [gfcm] OF DC MOTOR ON ROTATIONAL SHAFT |
|---|---|
| DRIVE UNIT WITH REGENERATING MECHANISM (PRESENT EMBODIMENT) | 600 |
| DRIVE UNIT WITHOUT REGENERATING MECHANISM (RELATED ART) | 700 |

As illustrated in TABLE 2, the torque of the drive unit with the regenerating mechanism according to the embodiment was 600 gfcm, and the torque of the drive unit without the regenerating mechanism according to the related art was 700 gfcm.

Thus, there is a difference in the torque between the drive unit according to the embodiment and the related art drive unit, exhibiting an effect of 100 gfcm in the drive unit with the regenerating mechanism according to the embodiment. The obtained 100 gfcm corresponds to 110 gfcm that is obtained by converting the torque limiter value of 1000 gfcm into that of the rotational shaft of the DC motor. The obtained 100 gfcm corresponds to 110 gfcm that is obtained by converting the torque limiter value of 1000 gfcm into that of the rotational shaft of the DC motor. Therefore, it is assumed that the expected amount of drive force is regenerated by the regenerating mechanism.

The drive unit according to the embodiment of the invention includes the regenerating mechanism including the first clutch-fitting pulley (low rotation pulley) having the first one-way clutch that can be locked and slipped in the same relative rotational direction as the second one-way clutch. The regenerating mechanism is provided between the roll-sheet drive mechanism having the torque limiter and the progressive mechanism such that the regenerating mechanism can be switchable with the rewinding mechanism including the second clutch-fitting pulley (high rotation pulley) having the second one-way clutch. Further, in the drive unit according to the embodiment of the invention, the rotational speed of the output shaft of the torque limiter is set in advance such that the rotational speed of the output shaft of the torque limiter is equal to or higher than the rotational speed of the first clutch-fitting pulley (low rotation pulley) and equal to or lower than the rotational speed of the second clutch-fitting pulley (high rotation pulley). Accordingly, when the first one-way clutch is locked while the second one-way clutch slips during the progressive operation, the rotational drive force in an amount corresponding to the torque limiter is obtained and the obtained rotational drive force is transmitted to the progressive mechanism. As a result, in the progressive mechanism, the transmitted rotational drive force is regenerated as another drive force in addition to the drive force generated from the motor.

[Modification]

Next, a modification of the drive unit of the roll-sheet feeding device according to the embodiment is described with reference to FIG. 9.

Figure 9:
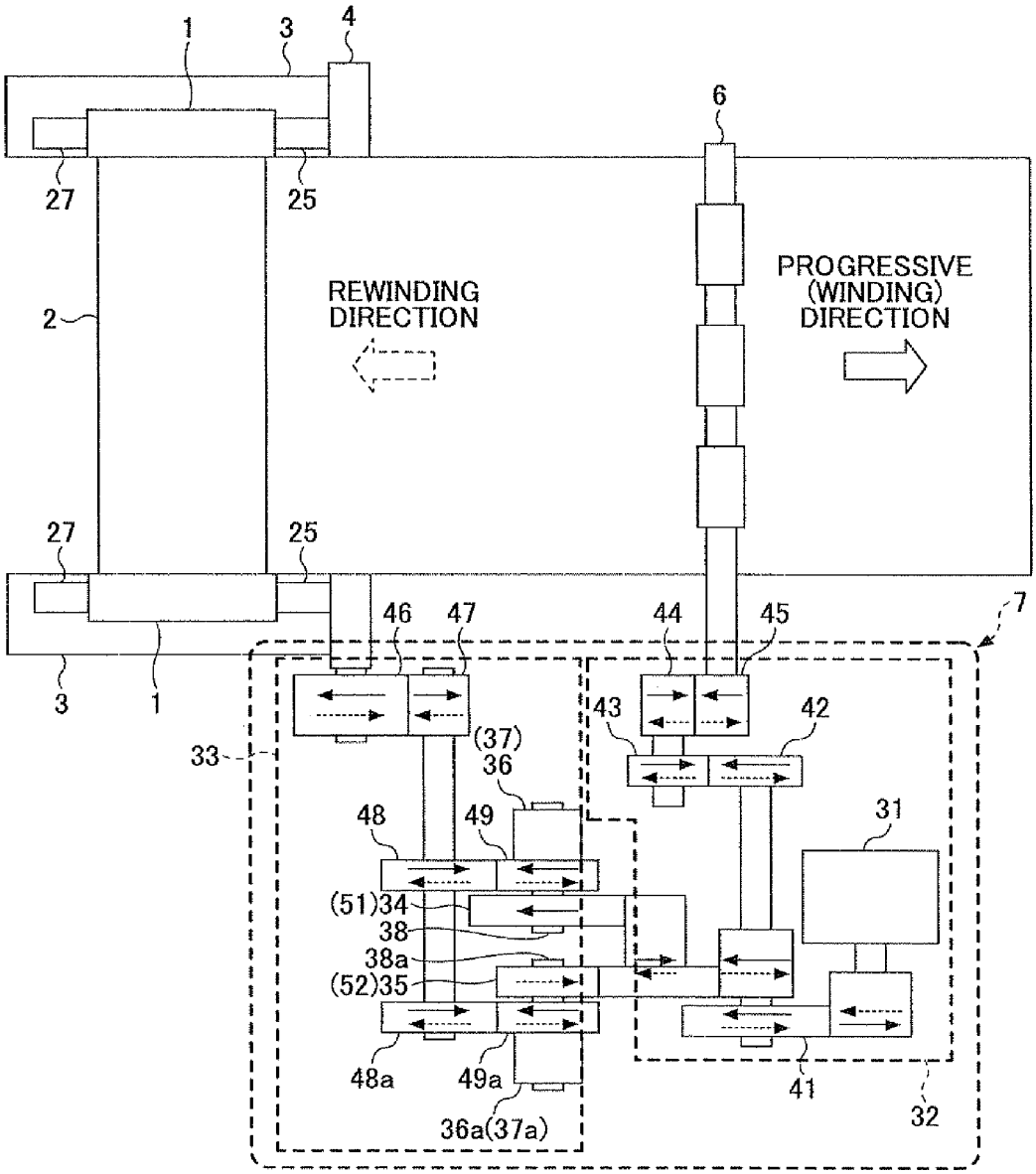
FIG. 9 is a diagram schematically illustrating a configuration of a drive unit of a roll-sheet feeding device according to a modification.

FIG. 9 is a diagram schematically illustrating a drive unit of the roll-sheet feeding device according to the modification.

The drive unit of the roll-sheet feeding device according to the modification differs from the above embodiment in that the second one-way clutch is not provided on the same shaft as the first one-way clutch.

The drive unit of the roll-sheet feeding device according to the embodiment includes the second one-way clutch on the same shaft as the first one-way clutch however, the drive unit of the roll-sheet feeding device of the modification includes the first and second one-way clutches respectively provided on the first and second rotational shafts such that the drive force is transmitted from the roll-sheet drive mechanism to the first and second rotational shaft.

An inkjet printer as an image forming apparatus having the roll-sheet feeding device according to the modification is configured in a similar manner as the inkjet printer according to the embodiment illustrated in FIG. 1A.

A progressive mechanism 32 of the drive unit of the roll-sheet feeding device according to the modification is configured in a similar manner as that of the drive unit of the roll-sheet feeding device according to the above embodiment.

However, the roll-sheet drive mechanism 33, the regenerating mechanism 34, and the rewinding mechanism 35 of the drive unit of the roll-sheet feeding device according to the modification are configured differently in the following points as those of the drive unit of the roll-sheet feeding device according to the above embodiment.

The roll-sheet drive mechanism 33 according to the modification further includes a thirteenth gear 48*a*, a fourteenth gear 49*a*, and a second torque limiter 36*a*, in addition to the sixth gear 46, the seventh gear 47, the eighth gear 48, the ninth gear 49, and the torque limiter 36 (hereinafter called a "first torque limiter"). The sixth gear 46, the seventh gear 47, the eighth gear 48, and the ninth gear 49 provided for the roll-sheet drive mechanism 33 according to the modification are the same as those provided for the roll-sheet drive mechanism 33 according to the above embodiment. However, the thirteenth gear 48*a* is provided on the same shaft as the seventh gear 47 and the eighth gear 48. The fourteenth gear 49*a* is provided on a shaft differing from the shaft of the thirteenth gear 48*a* or the shaft of the ninth gear 46 so that drive force is transmitted between the thirteenth gear 48*a* and the fourteenth gear 49*a*. The first torque limiter 36 (first load generating mechanism) includes the input shaft 38 (first rotational shaft) and the output shaft 37. The output shaft 37 of the torque limiter 36 and the ninth gear 49 are uniformly arranged so as to rotate in an integrated manner. The input shaft 38 of the first torque limiter 36 is arranged such that the input shaft 38 of the first torque limiter 38 can transmit the drive force to the progressive mechanism 32 via the regenerating mechanism 34. The second torque limiter 36*a* second load generating mechanism) includes an input shaft 38*a* (second rotational shaft) and an output shaft 37*a*. The output shaft 37*a* of the second torque limiter 36*a* and the fourteenth gear 49*a* are uniformly arranged so as to rotate in an integrated manner. The input shaft 38*a* of the second torque limiter 36*a* is arranged such that the input shaft 38*a* of the second torque limiter 36*a* receives the drive force from the progressive mechanism 32 via the rewinding mechanism 35.

In the modification, the first one-way clutch 51*a* and the second one-way clutch 52*a* are locked when relative rotation of the input shaft 38 of the first torque limiter 36 and the input shaft 38*a* of the second torque limiter 36*a* are in the rewinding direction whereas the first one-way clutch 51*a* and the second one-way clutch 52*a* are slipped when relative rotation of the input shaft 38 of the first torque limiter 36 and the input shaft 38*a* of the second torque limiter 36*a* are in the progressive (winding) direction. With such configurations, the drive source 31 can carry out the progressive operation and the rewinding operation via the roll-sheet drive mechanism 33 according to the modification.

So far, preferred embodiments including modification are described, however, they are not limited to those specifically described embodiments. Various modifications and alteration may be made within the scope of the inventions described in the claims.

As described above, the image forming apparatus according to the embodiments of the present invention is not limited to the inkjet printers insofar as those include a roll-sheet feeding device that feeds a roll-sheet type medium such as a roll sheet wound in a roll, such as a printer, a plotter, a facsimile machine, and a copier. That is, the roll-sheet feeding device according to the embodiments of the present invention can be used in various image forming apparatuses including a printer, a plotter, a facsimile machine, and a copier.

According to at least one embodiment of the present invention, there is provided the flange type roll-sheet feeding device capable of preventing a roll sheet from being loosened while stably transferring the roll sheet, reducing the load imposed on the electric motor and lowering power consumption, and an image forming apparatus including such a flange type roll-sheet feeding device.

The descriptions of exemplary embodiments for implementing the invention have been provided heretofore. The present invention is not limited to these embodiments, but various variations and modifications may be made without departing from the scope of the present invention.

The present application is based on Japanese priority application No. 2009-150819 filed on Jun. 25, 2009, with the Japanese Patent Office, the entire contents of which are hereby incorporated by reference.

What is claimed is:

1. A roll-sheet feeding device having a roll sheet wound in a roll to feed a portion of the roll sheet, the roll-sheet feeding device comprising:

a progressive mechanism configured to transmit a drive force from a drive source to transfer the portion of the roll sheet from the roll in a progressive direction in which the roll sheet is transferred from the roll;

a roll-sheet drive mechanism configured to receive a derived force transmitted via the portion of the roll sheet transferred in the progressive direction by the rotation of the roll rotationally driven by the drive force from the drive source;

a rewinding mechanism configured to transfer the portion of the roll sheet in a direction opposite to the progressive direction via the roll-sheet drive mechanism to rewind the roll sheet; and a regenerating mechanism configured to obtain the derived force from the roll-sheet drive mechanism to transmit the obtained force to the progressive mechanism to regenerate the obtained force as a transferring force to transfer the roll-sheet from the roll in the progressive direction.

2. The roll-sheet feeding device as claimed in claim 1, wherein the roll-sheet drive mechanism includes a first load generating mechanism configured to generate a first rotational load by the transfer of the portion of the roll sheet in the progressive direction and applies the first rotational load as a transfer load to the portion of the roll-sheet transferred in the progressive direction.

3. The roll-sheet feeding device as claimed in claim 2, wherein the rewinding mechanism and the regenerating mechanism are provided such that the rewinding mechanism and the regenerating mechanism are switchable based on a rotational direction of the drive source, and the regenerating mechanism is activated when the drive source rotates in the progressive direction and the rewinding mechanism is activated when the drive source rotates in a rewinding direction.

4. The roll-sheet feeding device as claimed in claim 3, wherein the regenerating mechanism includes a first one-way clutch, and the regenerating mechanism is switched from the rewinding mechanism when the first one-way clutch is locked by the rotation of the drive source in the progressive direction so as to transmit the drive force to the progressive mechanism.

5. The roll-sheet feeding device as claimed in claim 4, wherein the rewinding mechanism includes a second one-way clutch, and the rewinding mechanism is switched from the regenerating mechanism when the first one-way clutch slips during the rotation of the drive source in the rewinding direction while the second one-way clutch is locked so as to transmit the drive force to the roll sheet via the roll-sheet drive mechanism to rewind the portion of the roll sheet.

6. The roll-sheet feeding device as claimed in claim 5, wherein the regenerating mechanism is arranged on a rotational shaft that receives the derived force from the roll-sheet driving mechanism rotated in the progressive direction via the drive source and the portion of the roll sheet, and includes a first pulley or a first gear configured to be locked by the first one-way clutch when relatively rotating in the rewinding direction to the rotational shaft and allowed to slip the first one-way clutch when relatively rotating in the progressive direction to the rotational shaft, wherein the rewinding mechanism is arranged on the same rotational shaft on which the regenerating mechanism is arranged, and includes a second pulley or a second gear configured to be locked by the second one-way clutch when relatively rotating in the rewinding direction to the rotational shaft and allowed to slip the second one-way clutch when relatively rotating in the progressive direction to the rotational shaft, and wherein a first reduction ratio of the first pulley or the first gear to the drive source is greater than a second reduction ratio of the second pulley or the second gear to the drive source.

7. The roll-sheet feeding device as claimed in claim 6, wherein the first load generating mechanism is a first torque limiter that includes a first input shaft and a first output shaft, and the rotational shaft is the first input shaft of the first torque limiter.

8. The roll-sheet feeding device as claimed in claim 7, wherein when the portion of the roll sheet is transferred in the progressive direction, a rotational speed of the first output shaft of the first torque limiter is higher than a rotational speed of the first pulley or the first gear rotationally driven by the drive source.

9. The roll-sheet feeding device as claimed in claim 5, wherein the regenerating mechanism is arranged on a first rotational shaft that receives the derived force from the roll-sheet drive mechanism rotated in the progressive direction via the drive source and the portion of the roll sheet, and includes a first pulley or a first gear configured to be locked by the first one-way clutch when relatively rotating in the rewinding direction to the first rotational shaft and allowed to slip the first one-way clutch when relatively rotating in the progressive direction to the first rotational shaft, wherein the rewinding mechanism is arranged on a second rotational shaft that receives the derived force from the roll-sheet drive mechanism rotated in the progressive direction via the drive source and the portion of the roll sheet, and includes a second pulley or a second gear configured to be locked by the second one-way clutch when relatively rotating in the rewinding direction to the second rotational shaft and allowed to slip the second one-way clutch when relatively rotating in the progressive direction to the second rotational shaft, and wherein a first reduction ratio of the first pulley or the first gear to the drive source is greater than a second reduction ratio of the second pulley or the second gear to the drive source.

10. The roll-sheet feeding device as claimed in claim 9, wherein the roll-sheet drive mechanism includes a second load generating mechanism configured to generate a second rotational load and apply the second rotational load generated by the second load generating mechanism as a drive force to the portion of the roll-sheet, and wherein the first load generating mechanism is a first torque limiter that includes a first input shaft and a first output shaft, the second load generating mechanism is a second torque limiter that includes a second input shaft and a second output shaft, he first rotational shaft is the first input shaft of the first torque limiter, and the second rotational shaft is the second input shaft of the second torque limiter.

11. The roll-sheet feeding device as claimed in claim 10, wherein when the portion of the roll sheet is transferred in the progressive direction, a rotational speed of the first output shaft of the first torque limiter is higher than a rotational speed of the first pulley or the first gear rotationally driven by the drive source.

12. The roll-sheet feeding device as claimed in claim 3, further comprising:

first and second flange members respectively attached to first and second ends of the roll sheet;

first and second rotational support members configured to rotationally support the first and the second flange members, respectively; and a rewinding roller configured to obtain the derived force from the roll-sheet drive mechanism and transmit the obtained force to at least one of the first and the second rotational support members, or obtain the derived force from the at least one of the first and the second rotational support members and transmit the obtained force to the roll-sheet drive mechanism, wherein the rewinding roller is engaged with the first and the second rotational support members so as not to slip over each other, and the first and the second flange members are respectively engaged with the first and the second rotational support members so as not to slip over one another.

13. The roll-sheet feeding device as claimed in claim 12, wherein the rewinding roller is engaged with the first and the second rotational support members via gears, and the first and the second flange members are respectively engaged with the first and the second rotational support members via respective gears.

14. The roll-sheet feeding device as claimed in claim 12, wherein the first and the second rotational support members are coated with rubber so that the rewinding roller is engaged with the first and the second rotational support members via the rubber, and the first and the second flange members are respectively engaged with the first and the second rotational support members via the rubber.

15. An image forming apparatus comprising:

an image forming unit configured to form images on a roll sheet; and the roll-sheet feeding device as claimed in claim 1.

* * * * *